United States Patent [19]

Locher

[11] Patent Number: 4,747,640

[45] Date of Patent: May 31, 1988

[54] CHAIR SUPPORT

[75] Inventor: Hermann Locher, Dornach, Switzerland

[73] Assignee: Giroflex Entwicklungs AG, Koblenz, Switzerland

[21] Appl. No.: 96,333

[22] Filed: Sep. 14, 1987

[30] Foreign Application Priority Data

Sep. 24, 1986 [CH] Switzerland ..... 3842/86

[51] Int. Cl.[4] ..... A47C 3/00

[52] U.S. Cl. ..... 297/301; 297/300; 297/355

[58] Field of Search ..... 297/301, 300, 304, 355

[56] References Cited

U.S. PATENT DOCUMENTS

| | | | |
|---|---|---|---|
| 4,471,994 | 9/1984 | Zund et al. | 297/300 |
| 4,629,249 | 12/1986 | Yamaguchi | 297/301 |
| 4,682,814 | 7/1987 | Hansen | 297/301 |
| 4,682,815 | 7/1987 | Steifensand | 297/300 |
| 4,709,962 | 12/1987 | Steinmann | 297/301 |
| 4,718,725 | 1/1988 | Suhr et al. | 297/301 |

*Primary Examiner*—Francis K. Zugel
*Attorney, Agent, or Firm*—Werner W. Kleeman

[57] ABSTRACT

The chair support comprises a supporting structure, a seat holder and a backrest holder. The seat holder is pivotably or swivelably connected by means of a first swivel joint with the supporting structure and by means of a second swivel joint with the backrest holder. The backrest holder possesses an arm or arm structure and a substantially flat-surfaced hollow tube which is fitted and fastened in a holding support of the arm. The arm or arm structure projecting into about the middle of the chair support between the first and the second swivel joint is connected with a third swivel joint by means of guide rods or links which are supported at the supporting structure by means of a fourth swivel joint. A first spring element engages at the third swivel joint and a second spring element engages at the supporting structure. Both spring elements are releasable and blockable by means of operating or actuating rods. In spite of the space-saving and simple construction of the chair support, the usual seating comfort of such chairs is offered.

10 Claims, 2 Drawing Sheets

CHAIR SUPPORT

CROSS REFERENCE TO RELATED APPLICATION

This application is related to my commonly assigned, copending U.S. application Ser. No. 07/096,334, filed Sept. 14, 1987, and entitled "Chair Support With Adjustment Device".

BACKGROUND OF THE INVENTION

The present invention relates to a new and improved construction of a chair support or chair frame structure.

In its more specific aspects, the present invention relates to a new and improved construction of a chair support or chair frame structure equipped with a seat holder or support and a backrest holder or support. The seat holder or support is inclinably or reclinably connected at the front end thereof where the seat user's knees will fit with a supporting or support structure by means of a first swivel or pivot joint possessing a substantially horizontal axis of rotation and is inclinably or reclinably connected at the backrest end of such seat holder or support with the backrest holder or support by means of a second swivel or pivot joint possessing a substantially horizontal axis of rotation. The backrest holder or support possesses an arm or arm structure extending from the second swivel or pivot joint towards the supporting structure and which arm or arm structure is pivoted or swivelably connected at the supporting structure by means of a third swivel or pivot joint possessing a substantially horizontal axis of rotation. At the backrest holder or support there acts a spring or resilient element supported at the supporting structure, and the supporting structure is supported at a foot support or foot frame unit by means of a second spring or resilient element.

Chairs, whose chair support or frame structure is constructed with a backwardly-inclinable seat holder and a backrest holder, are known from various prior art constructions. In the simplest known exemplary form, one end of both the seat holder and the backrest holder is swivelably or hingeably connected in spaced relationship from a supporting structure about a respective horizontal axis or shaft, whereby the seat holder or part is connected at its other end with the backrest holder by means of a swivel or pivot joint. When the seat holder or part is tilted backwards, the backrest holder tilts as well as the seat holder or part, and for this purpose one of the swivel or pivot joints is additionally constructed as a sliding joint or else an extra or supplementary connecting link or bracket is positioned at one of the swivel or pivot joints.

In order to increase the seating comfort, it is known, for example, from my commonly assigned U.S. Pat. No. 4,502,729, granted Mar. 5, 1985, and entitled "Chair, Especially a Reclining Chair", to position a height-adjustable backrest at the backrest holder or carrier, which is moved downwards by an amount corresponding to or in functional relationship to the backwards or rearward inclination of the seat holder or carrier.

In order to arrange this displaceable or slidable backrest in a functionally satisfactory manner, it is necessary to construct the backrest holder or carrier as a double support or column. However, this entails a greatly increased expenditure of materials which results in correspondingly greater costs.

SUMMARY OF THE INVENTION

Therefore with the foregoing in mind, it is a primary object of the present invention to provide a new and improved construction of a chair support or frame structure which does not exhibit the aforementioned drawbacks and shortcomings of the prior art constructions.

Another and more specific object of the present invention aims at the provision of a new and improved construction of a chair support or the like that achieves a reduction in the costs of construction while maintaining at least a comparable level of comfort for the user of the chair.

Still another important object of the present invention aims at the provision of a new and improved construction of a chair support or the like which is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the chair support or frame structure of the present invention is manifested by the features that the first spring element is positioned between the free end of the arm or arm structure of the backrest holder and the front end, i.e. on the side where the seat user's knees will fit, of the supporting or support structure, and furthermore, that the seat holder is composed of two partial seat holders or carrier supports disposed adjacent each other in spaced relationship, between which the seat supporting structure lies, and still further that, the seat holder is connected together with the backrest holder by means of the second swivel joint which is constructed as a torsion spring.

Both the partial seat holders or carrier supports are advantageously connected with each other at the front end thereof by means of the first swivel or pivot joint and at the backrest side or end thereof by means of the second swivel or pivot joint.

The arm or arm structure of the backrest holder is likewise advantageously composed of two partial arms lying beside or adjacent each other in spaced relationship. Underneath the second swivel or pivot joint, these two partial arms form a holding support, into which the backrest holder, for instance constructed as a single hollow tube fits and is fixedly connected therewith, for example by welding.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
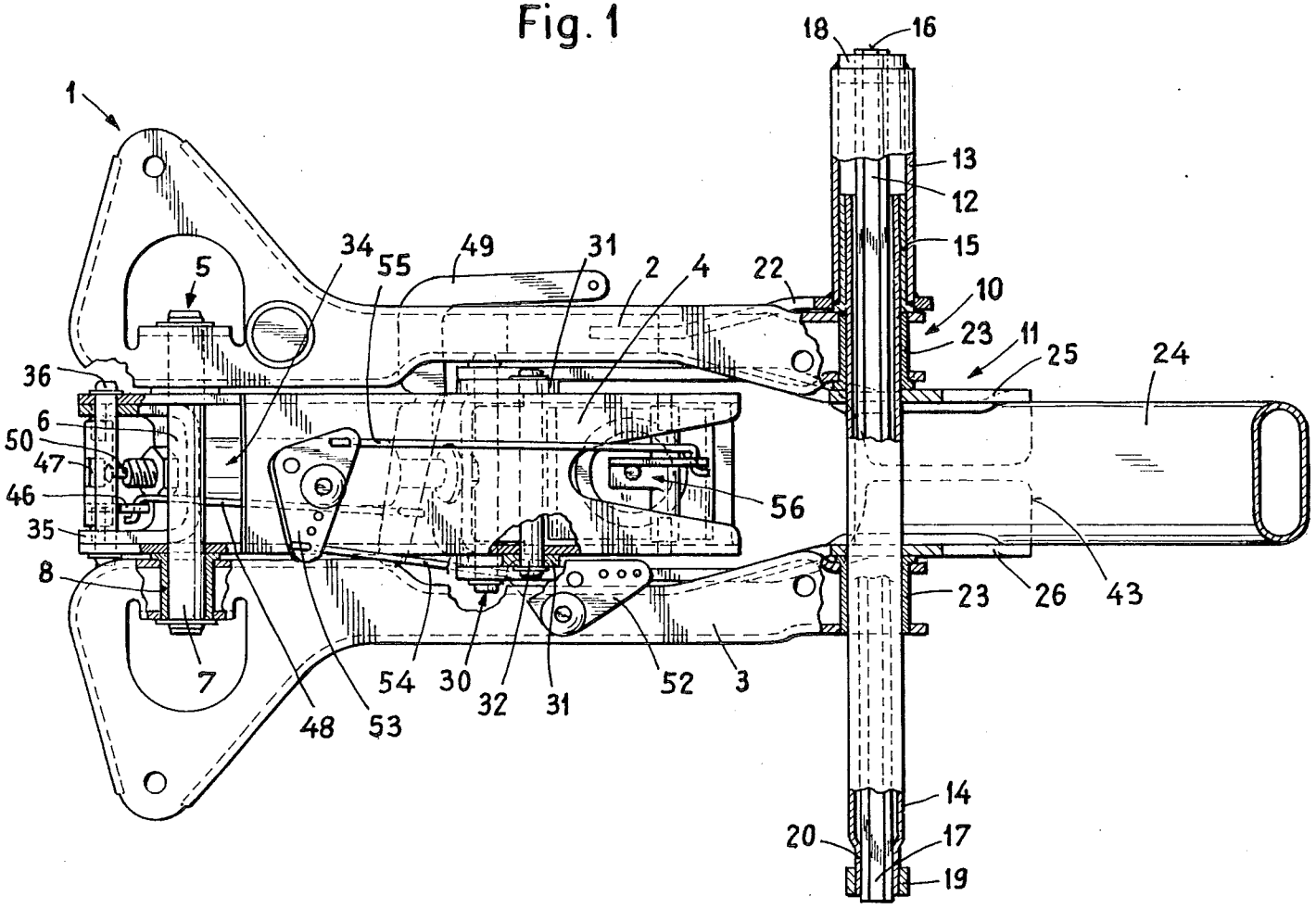
FIG. 1 illustrates a plan view of a chair support or frame structure constructed according to the present invention.
Figure 2:
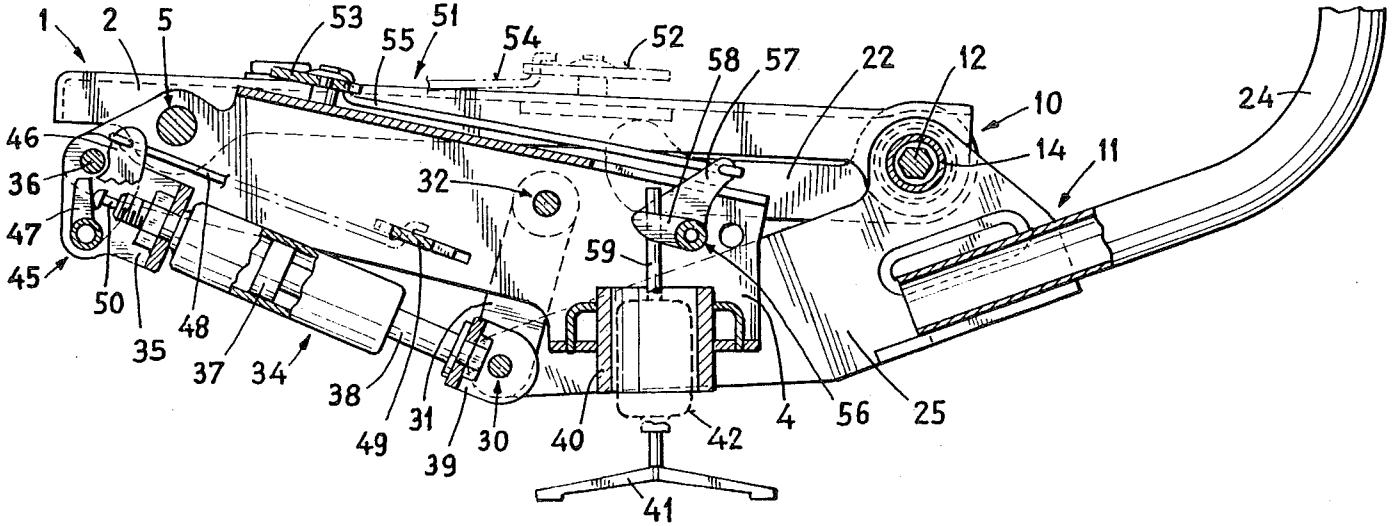
FIG. 2 is a side view, partially in section, of the chair support or frame structure depicted in FIG. 1.

Describing now the drawings, it is to be understood that to simplify the showing thereof, only enough of the construction of the chair support or frame structure 1 has been illustrated therein as is needed to enable one skilled in the art to readily understand the underlying principles and concepts of the present invention. Turning now specifically to FIGS. 1 and 2 of the drawings, the chair support or frame structure 1 illustrated therein by way of example and not limitation, will be seen to comprise a seat holder or support 2, 3 composed of two partial seat holders or seat holder parts 2 and 3 lying adjacent to and in spaced relationship from each other. Between the two partial seat holders 2 and 3, a supporting or support structure 4 is positioned, at the front end or user's knee-side end of which the two partial seat holders 2 and 3 are supported by means of a first swivel or pivot joint 5. The first swivel or pivot joint 5 essentially consists of a shaft or spindle 6, which forms a journal 7 on both opposite ends or sides thereof, on which the two partial seat holders 2 and 3 are mounted by means of a journal bushing 8 or equivalent structure.

At the backrest end or side of the chair support or frame structure 1 and such partial seat holders 2 and 3, these partial seat holders 2 and 3 are connected with a backrest holder or support 11 by means of a second swivel or pivot joint 10. The second swivel or pivot joint 10 is constructed as a torsion spring element or torsion spring and consists of a spring or resilient bar or rod 12, two connecting or connection tubes 13, 14 and a guide sleeve or bushing 15. The spring bar or rod 12 is fastened with one end 16 in the base or bottom portion 18 of the external connecting or connection tube 13 and extends through both the partial seat holders 2 and 3 and the other end 17 of the spring bar or rod 12 is guided in an end portion 20 of the inner connecting or connection tube 14 reinforced or strengthened by a sleeve or sleeve member 19.

The external connecting tube 13 is fixedly connected, for example welded, with a holding or holder arm 22, which, in turn, is supported at the partial seat holder or seat holder part 2, while the inner connecting tube 14 is mounted in sleeves or sleeve members 23 in the partial seat holders or seat holder parts 2 and 3 and is guided in the guide sleeves or bushings 15 positioned in the outer connecting tube 13. The inner connecting tube 14 is fixedly connected with the backrest, holder or support 11.

The backrest holder or support 11 comprises a substantially flat-surfaced hollow tube 24 extending into the region of the second swivel or pivot joint 10 and an arm or arm structure 25, 26 composed of two partial arms or arm members 25 and 26. The arm or arm structure 25, 26 extends to approximately half the distance between the first and second swivel joints 5, 10 and is connected by means of a third swivel joint 30 with two guide rods or links 31 positioned on both sides of the supporting or support structure 4. The guide rods or links 31 are for their part supported at the supporting or support structure 4 by means of a fourth swivel or pivot joint 32.

As will be best seen by referring to FIG. 2, at the third swivel or pivot joint 30, one end of a first spring or resilient element 34, for example a gas spring, is supported while the other end thereof, fixedly connected with a two-armed bracket or bracket member 35, is pivotably connected with a shaft or spindle 36 mounted in the supporting or support structure 4.

As can be likewise seen in FIG. 2, the spring or resilient element 34 possesses a piston or piston member 37 and a piston rod 38. The piston rod 38 is connected by means of a further bracket or bracket member 39 with the third swivel or pivot joint 30. The piston 37 is fixedly connected to the two-armed bracket 35. The first spring element 34 also may comprise a suitable compression or pressure spring means.

The underside of the supporting or support structure 4, appropriately constructed as a substantially bowl or dish-shaped hollow body, is connected with a substantially cylindrical piece or element 40, with which the connection with a schematically indicated foot support or chair base 41 is realized. This connection is constructed in a not particularly illustrated but conventional manner in an elevationally or height-adjustable telescope connection by means of a second spring or resilient element 42, for example a conventional gas spring, conveniently indicated by the dotted line. Here also the second spring 42 may comprise a suitable compression or pressure spring means.

The backrest holder or support 11 composed of the substantially flat-surfaced hollow tube 24 and the arm or arm structure 25, 26 represents a simple element. The substantially flat-surfaced hollow tube 24 is bent or curved in the region of the second swivel or pivot joint 10 and exhibits an inclination with respect to the top surface of the seat holder or support 2, 3 of 15° to 45°, preferably 18° to 30°, at the end thereof located at the side of the seat holder or support 2, 3 and such hollow tube 24 further possesses an inclination of about 80° to 100° at the backrest end or region thereof supporting the chair backrest. Moreover, this hollow tube 24 is fitted or seated with its end in a holding support or holder 43 formed by the partial arms 25, 26 and fixedly connected with the two partial arms 25 and 26, for example by welding. The supporting force for the backrest holder or support 11, acting against the force exerted by the chair user when leaning against the backrest, is applied with the first spring element 34 supported at the two partial arms 25 and 26 by means of the fourth swivel or pivot joint 32.

In this way, the seating comfort is increased, so that the first and second spring or resilient elements 34, 42 can be positionally fixed according to need in a desired position and then released from this position.

For the operation of the first spring element 34, a two-armed angle lever 45 is rotatably mounted in the two-armed bracket 35; one arm 46 of the two-armed angle lever 45 is connected with an operating or actuating rod or rod structure 48, 49, while the other arm 47 acts on a slide tappet or plunger 50, with which the release and blocking of the first spring or resilient element 34 is undertaken. The operating or actuating rod or rod structure 48, 49 lies somewhat under the seat surface of the chair and can be conveniently operated in a here not further illustrated manner by the chair user. However, details of such arrangement and its mode of operation constitute subject matter of the aforementioned commonly assigned, co-pending U.S. application Ser. No. 096,334, filed Sept. 14, 1987, and entitled "Chair Support with Adjustment Device" to which reference may be readily had.

For the releasing and blocking of the second spring or resilient element 42, there is provided a further operating or actuating rod or rod structure 51 likewise mounted in the supporting or support structure 4 and partially in the seat holder or support 2, 3. The operating or actuating rod or rod structure 51 comprises two double-armed or two-armed levers 52, 53 and two rods or rod members 54, 55. In the supporting structure 4, a two-armed operating or actuating lever 56 is swivelably or pivotably mounted above the second spring or resilient element 42. One arm 57 of the two-armed operating or actuating lever 56 is connected to the rod 55, while the other arm 58 for the operation of a slide tappet or plunger 59 of the second spring or resilient element 42 serves to loosen and fix this second spring or resilient element 42. The arrangement of the operating or actuating rod 51 renders possible the unhindered relative movement of the seat holder 2, 3 and the supporting or support structure 4.

The described chair support consists of just a few main parts arranged in a space-saving way. In this manner, an economic solution is realized, which in addition avoids a bulky construction of the chair support or frame structure 1. Moreover, through the possibility of operating the two operating or actuating rods 48, 49 and 51, the usual seating comfort is available to the user of the chair. As mentioned above further details of the chair adjustment device are disclosed in the aforementioned commonly assigned, co-pending United States application.

While there are shown and described present preferred embodiments of the invention, it is to be distinctly understood that the invention is not limited thereto, but may be otherwise variously embodied and practiced within the scope of the following claims.

Accordingly, what I claim is:

1. A chair support, comprising:
a seat holder having a front end and a backrest end;
a backrest holder;
a first swivel joint possessing a substantial horizontal axis of rotation;
a supporting structure inclinably connected with the front end of said seat holder by means of said first swivel joint;
a second swivel joint possessing a substantially horizontal axis of rotation inclinably connecting the backrest end of said seat holder with said backrest holder;
said backrest holder possessing.arm means having a free end;
said arm means extending from said second swivel joint towards the supporting structure;
a third swivel joint possessing a substantially horizontal axis of rotation for pivotably connecting said arm means at said supporting structure;
a first spring element supported at said supporting structure acting at said backrest holder;
a foot support;
a second spring element for supporting said supporting structure at said foot support;
said first spring element being positioned between the free end of said arm means of said backrest holder and the front end of said support structure;
said seat holder comprising two partial seat holders arranged adjacent and in spaced relationship from one another;
said supporting structure being disposed between said partial seat holders; and
said second swivel joint being constructed as a torsion spring and connecting said seat holder to said backrest holder.

2. The chair support as defined in claim 1, wherein:
said first swivel joint interconnects said two partial seat holders of said seat holder with one another at the front end of said seat holder; and
said second swivel joint interconnecting said two partial seat holders with one another at the region of said backrest end of said seat holder.

3. The chair support as defined in claim 1, wherein:
the arm means of said backrest holder comprises two partial arms located adjacent and in spaced relationship from one another.

4. The chair support as defined in claim 3, further including:
a single hollow tube; and
said backrest holder comprising said arm means and said single hollow tube.

5. The chair support as defined in claim 4, wherein:
said single hollow tube defines a substantially flat-surfaced hollow tube; and
said two partial arms defining a holding support located underneath said second swivel joint for receiving said substantially flat-surfaced hollow tube.

6. The chair support as defined in claim 5, wherein:
said single hollow tube having an end extending towards the seat holder; and
the end of said single hollow tube extending towards the seat holder fitting into and being fixedly connected with said holding support of said two partial arms.

7. The chair support as defined in claim 6, wherein:
said end of said single hollow tube being fixedly connected by welding with said holding support of said two partial arms.

8. The chair support as defined in claim 4, wherein:
said single hollow tube has an end extending towards the seat holder; and
said end of said single hollow tube extending towards said seat holder possesses an inclination of about 15° to 45° with respect to the seat holder; and
said hollow tube having a backrest end which possesses an inclination of 80° to 100° with respect to the seat holder.

9. The chair support as defined in claim 8, wherein:
said end of said hollow tube extending towards said seat holder possesses an inclination of 18° to 30° with respect to the seat holder.

10. The chair support as defined in claim 1, wherein:
said first and second spring elements are each constructed as compression spring means;
a respective slide tappet provided for each said compression spring means of said first and second spring elements; and
a respective operating rod provided for each said slide tappet for blocking and releasing the related compression spring means.

* * * * *